US007331132B1

(12) United States Patent
Seder

(10) Patent No.: US 7,331,132 B1
(45) Date of Patent: Feb. 19, 2008

(54) ROTATABLE ANIMATION DEVICE

(76) Inventor: Rufus Butler Seder, 971 Commonwealth Ave., Boston, MA (US) 02215

( * ) Notice: Subject to any disclaimer, the term of this patent is extended or adjusted under 35 U.S.C. 154(b) by 17 days.

(21) Appl. No.: 11/270,970

(22) Filed: Nov. 12, 2005

Related U.S. Application Data

(60) Provisional application No. 60/627,796, filed on Nov. 12, 2004.

(51) Int. Cl.
*G09F 11/04* (2006.01)

(52) U.S. Cl. ..... 40/495

(58) Field of Classification Search ..... 40/495, 40/534; 434/405
See application file for complete search history.

(56) References Cited

U.S. PATENT DOCUMENTS

| | | | | | |
|---|---|---|---|---|---|
| 29,430 | A | * | 7/1860 | Ames | 40/495 |
| 697,907 | A | * | 4/1902 | Wilder | 40/495 |
| 1,259,297 | A | | 3/1918 | Russell | |
| 1,285,753 | A | | 11/1918 | Lowenstein | |
| 1,474,572 | A | | 11/1923 | Whitstock | |
| 1,804,260 | A | * | 5/1931 | Kerr | 446/256 |
| 2,085,803 | A | | 7/1937 | Harrison | |
| 2,350,733 | A | * | 6/1944 | Drotning | 116/312 |
| 2,367,967 | A | | 1/1945 | Schwartz | |
| 2,374,371 | A | | 4/1945 | Morch | |
| 2,398,257 | A | | 4/1946 | Schwartz | |
| 2,551,188 | A | * | 5/1951 | Wagner | 40/495 |
| 2,959,872 | A | * | 11/1960 | Rodgers | 434/404 |
| 3,268,238 | A | | 8/1966 | Finkel | |
| 3,314,179 | A | | 4/1967 | Leach | |
| 3,643,361 | A | | 2/1972 | Eaves | |
| 3,826,028 | A | * | 7/1974 | Shaw | 40/495 |
| 3,862,504 | A | | 1/1975 | Ringeleim et al. | |
| 4,118,879 | A | | 10/1978 | Simon | |
| 4,789,573 | A | | 12/1988 | Jenkinson | |
| 4,885,193 | A | | 12/1989 | Head | |
| 5,695,346 | A | | 12/1997 | Sekiguchi | |
| 5,782,026 | A | | 7/1998 | Capie | |
| 5,823,344 | A | | 10/1998 | Fanton et al. | |
| 5,901,484 | A | | 5/1999 | Seder | |
| 6,286,873 | B1 | | 9/2001 | Seder | |
| 6,385,875 | B1 | * | 5/2002 | Santorsola | 40/124.191 |

* cited by examiner

*Primary Examiner*—Lesley D. Morris
*Assistant Examiner*—Christopher E Veraa
(74) *Attorney, Agent, or Firm*—O'Connell Law Firm

(57) ABSTRACT

A rotatable animation device with a first substrate member rotatable relative to a second substrate member. A plurality of coded images are disposed on one substrate member, and a plurality of shutter elements and interposed viewing sections are disposed on the other substrate member to establish a viewing area. The coded images are sequentially completed in response to a relative rotation between the substrate members. The first substrate member can be flexible to enable a deflection into contact with the second substrate member. The inner surface of the first substrate member can have a resiliently compressible concave portion, which can include at least a ring portion of the first substrate member. The concave portion can be induced by at least one biasing surface deformation, such as a crease. A case, a centrally disposed fastening arrangement, or another mechanism can induce a compression of the first substrate member.

18 Claims, 8 Drawing Sheets

ROTATABLE ANIMATION DEVICE

FIELD OF THE INVENTION

The present invention relates generally to display devices. More particularly, disclosed herein is an animated display device for sequentially displaying a plurality of images in response to a rotation of a shutter member relative to an image member.

BACKGROUND OF THE INVENTION

Devices permitting the sequential display of a plurality of coded images by relative movement of an image member relative to a shutter member have been known for many years. Typically, the image member has a plurality of interposed coded images thereon while the shutter member has a plurality of shutter elements that are separated by a plurality of viewing elements. The shutter elements perform the dual functions of selectively blocking from view all but one of the interposed coded images while bridging the gaps between the coded strips to form what can be termed an active image. The shutter elements uncode the active image of the coded images, and the active image appears to be complete.

When the image member and the shutter member undergo relative movement by a predetermined amount, the strips of the previously active image are concealed and the next succeeding coded image assumes the fleeting position as an active image. This procedure will continue through a cycle consisting of all coded images that are disposed on the image member. Once that cycle is complete, the first coded image will again appear to start a new, identical cycle.

The number of unique coded images is mathematically limited by the width of the shutter element relative to the width of the strips that form the coded images. Stated more particularly, the number of coded images cannot exceed one plus the result of the width of each shutter element divided by the width of each coded image strip. The ability to display images with clarity and resolution is dependent not only on the number of discrete images that can be displayed but also on the ability of the device to obtain precise registration and alignment between the coded images and the shutter elements and to maintain that precise registration during relative movement within the device.

Just as critical to the performance of such display devices is the ability of the device to achieve and maintain close contact between the shutter elements and the coded images over their entire display surfaces. Lack of complete contact between the shutter elements and the coded images creates thin air pockets between the layers thereby creating undesirable shadows that diminish the observer's ability to perceive the display image. Incomplete contact also results in an undesirable parallax viewing conflict where multiple images can be partially or completely perceived due to the ability of the observer to see around and, therefore, behind the shutter elements.

Where complete contact between the shutter elements and the coded images is not achieved, the intended animation effect will be frustrated and the designer may be forced to compensate by implementing a design with sufficiently few animation phases to eliminate the viewing conflicts and other resulting disadvantages. Conversely, where better contact can be achieved, more and clearer phases of animation are possible thereby enabling more advanced and intricate animation sequences.

In one type of animation device, a coded image member is rotatable, often manually, relative to a shutter member to achieve animation. Such optically animated display devices often cause the coded image member, which can be disk shaped, to be rotatable about a common axis in relation to the shutter member, which also can be disk shaped. In such devices, the two members have sometimes been loosely riveted or otherwise coupled together. The shutter member typically has opaque, radiating shutter elements while the coded image member, often the bottom of the two, typically has radiating coded images.

While such devices have been in existence for over a century, their full potential has yet to be realized for a number of reasons. For example, a rarely recognized yet essential requirement to achieve optimal results in such devices is that the shutter member and the coded image member must be held in complete contact against one another at all times, including before, during, and after rotation. Prior art devices have failed to do so in reliance on the assumption that the shutter and image members are both perfectly flat, which is normally not the case. Therefore, unless the shutter member is completely pressed against the image member, the shutter member generally will not conform to a surface on which it lies. With this, random areas of non-contact are created that compromise the optimal performance of the device in at least two ways.

First, areas of non-contact cause unwanted shadows to be cast by the upper shutter elements on the bottom coded image elements. This obscures the animated image, which even under the best of conditions is already perceived as dark since the shutter elements create a dark veil of necessary stripes over the depicted image. The resulting shadows create mottled patches of darkness that compromise the clear perception of the intended animated image.

Second, the areas of non-contact permit the observer to perceive portions of coded image elements that are intended to be hidden beneath shutter elements. With this, the successful incorporation of more than two or three phases of animation, which would require the use of finer and finer shutter elements and radiating coded images, is made functionally impossible since the slightest lack of contact reveals one or more other phases of animation to the observer at the wrong time. Since the observer typically sees with binocular vision, there is an unintentional perception of confusing double, triple, or even quadruple images thereby distracting from the intended animation. To date, these undesirable effects deriving from insufficient contact between the shutter member and the image member have limited the appeal of the devices to the general public and have, therefore, prevented their widespread commercial success.

Advantageously, the present inventor has appreciated that achieving optimal functional performance and, ideally, realizing full commercial success, demands that the shutter member and the image member be maintained in sufficient compression to achieve and maintain complete contact before, during, and after rotation. It is further recognized that the image and shutter members must simultaneously be readily movable, in this case rotatable, relative to one another.

The present inventor has demonstrated the functional improvements derived from imposing full contact between relatively slidable elements of optically animated devices in, for example, U.S. Pat. No. 5,901,484, entitled "Manually Operated Moveable Display Device," and in U.S. Provisional Patent App. No. 60/534,894, entitled "Moveable Animated Display Device." Each disclosure is incorporated herein by reference. Embodiments of each invention have achieved commercial success thereby attesting to the merit of this heretofore neglected, yet critical, improvement in the art and the need for an invention that can provide such improvements in relation to rotatable display devices.

SUMMARY OF THE INVENTION

Figure 1:
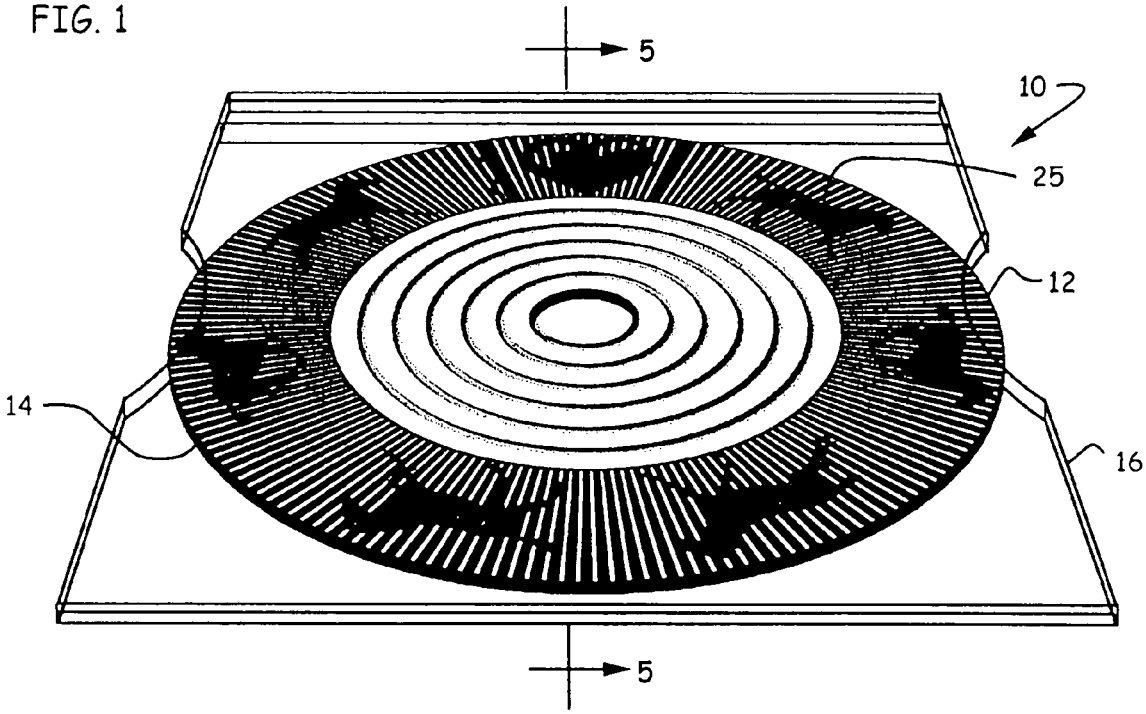
FIG. 1 is a perspective view of a manually operated rotatable animation device according to the invention disclosed herein.

The present invention has a fundamental object of providing a manually operated rotatable animation device that overcomes the disadvantages and deficiencies demonstrated by prior art rotatable animation devices.

A more particular object of embodiments of the invention is to provide an animation device that achieves and maintains complete contact between coded images of a coded image member and shutter elements of a shutter member.

Another object of the invention is to provide such an animation device that permits free rotation of a shutter member in relation to a coded image member.

A resultant object of embodiments of the invention is to provide a rotatable animation device that is capable of presenting animated images that are clear and bright.

A related object of the invention is to provide a rotatable animation device that enables the depiction of multiple phases of animation.

Another object of embodiments of the invention is to provide a rotatable animation device that can be operated manually.

These and in all likelihood further objects and advantages of the present invention will become obvious not only to one who reviews the present specification and drawings but also to those who have an opportunity to experience an embodiment of the rotatable animation devices disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth these objects, one embodiment of an animation device according to the present invention is founded on a first substrate member that is rotatably retained in relation to a second substrate member. A plurality of coded images can be disposed on one of the first and second substrate members while a plurality of shutter elements can be disposed on the other of the first and second substrate members. A plurality of viewing sections can be interposed between the plurality of shutter elements. At least a portion of the first substrate member can be flexible over a flexible portion such that the flexible portion can deflect to make contact with the second substrate member. The plurality of shutter elements and the plurality of viewing sections can be disposed to align with the plurality of coded images to establish a viewing area. Under this arrangement, the plurality of shutter elements can sequentially complete the plurality of coded images in response to a relative rotation between the first substrate member and the second substrate member.

In certain practices of the invention, at least the first substrate member can be generally round. In any case, the plurality of coded images, the plurality of shutter elements, and the plurality of viewing sections can be radially disposed on the first and second substrate members to define a generally annular viewing area. The flexible portion of the first substrate member can include at least a ring portion of the first substrate member such that at least the ring portion can deflect into contact with the inner surface of the second substrate member.

At least a portion of the first substrate member can be compressible so that a pressing on the first substrate member can induce a deflection of the first substrate member from a non-compressed configuration to a compressed configuration. In such embodiments, the inner surface of the first substrate member can have a resilient concave portion, possibly a bowl shape, whereby a pressing on the first substrate member will induce a deflection of the resilient concave portion of the first substrate member to a compressed configuration. The resilient concave portion can include at least a ring portion of the first substrate member such that the ring portion can deflect in response to a compression of the first substrate member.

The resilient concave portion can be formed or induced in the first substrate member by any effective means or method. In certain embodiments, for example, the resilient concave portion can be biased to a concave configuration at least partially by at least one biasing surface deformation disposed therein. In one example, the surface deformation or deformations can comprise creases disposed in the first substrate member, possibly with the peak thereof disposed along the outer surface of the first substrate member.

However, one will appreciate that numerous other biasing formations could be effective in biasing the first substrate member to have a concave portion. By way of example and not limitation, properly formed curves, bends, and still other configurations and mechanisms could induce the desired biasing and, as such, are well within the scope of the present invention and within the meaning of the phrase biasing formation. Substantially any number of biasing formations could be employed to exert the desired biasing leverage. The biasing formation or formations could be disposed in any configuration including in an annular format.

The first substrate member can be rotatably retained in relation to the second substrate member by any effective arrangement. Further, the rotatable animation device can incorporate a means for inducing a compression of the first substrate member to induce contact of the inner surfaces of the first and second substrate members. For example, the first and second substrate members can be retained relative to a case with a first and second case halves disposed outboard of the outer surfaces of the first and second substrate members. The case halves can be hingedly coupled, as in a compact disk case. The second substrate member could comprise a disk, and at least a portion of an edge of the second substrate member can be exposed in relation to the case. In further embodiments, at least the first substrate member can have a centrally disposed aperture and the means for inducing a compression of the first substrate member can comprise a concentrically disposed fastening arrangement. Alternatively or additionally, a plurality of tabs can be disposed about the periphery of the first substrate member for pressing the first substrate member into contact with the second substrate member.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The rotatable animation devices disclosed herein are subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 4:
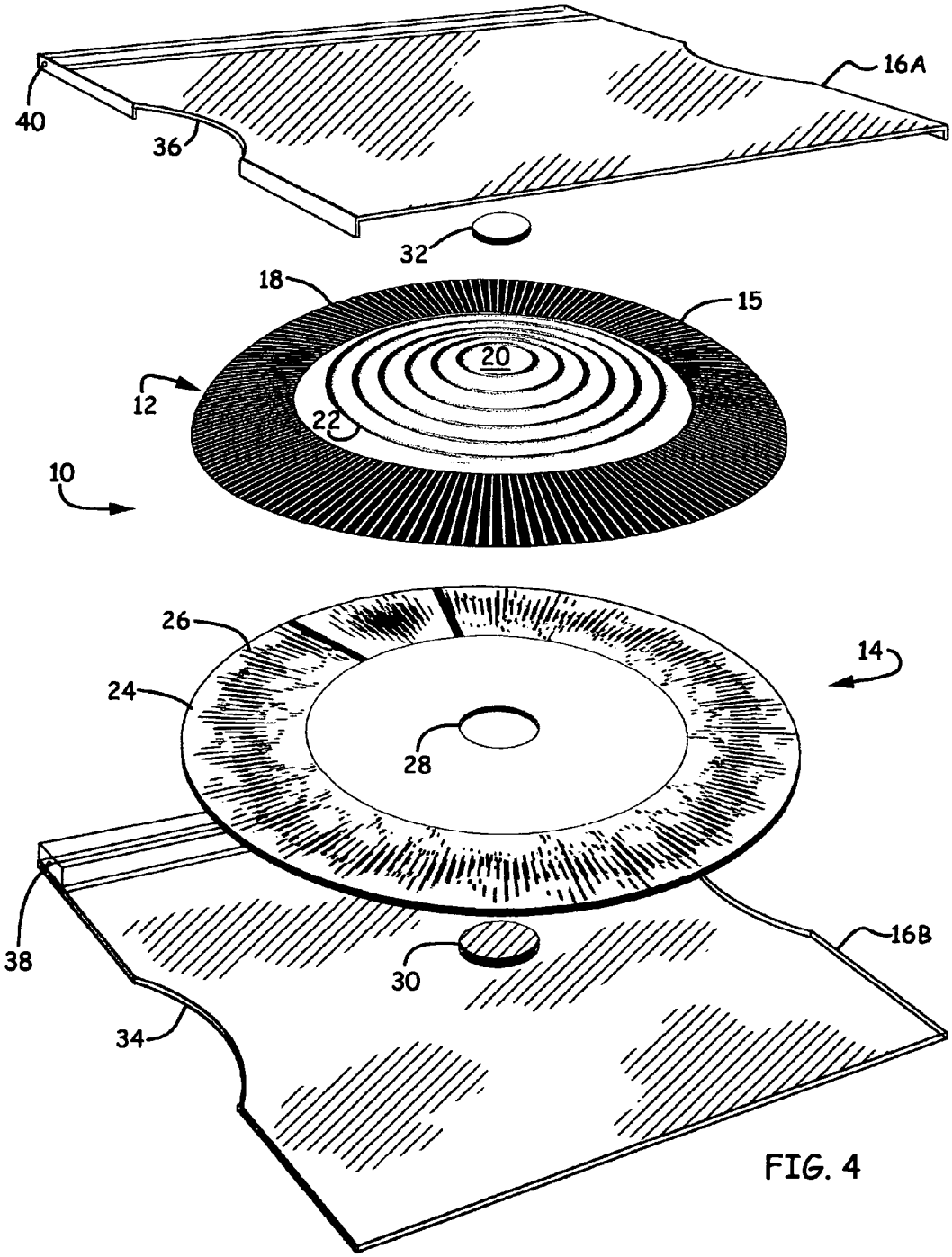
FIG. 4 is a perspective view of the manually operated rotatable animation device of FIG. 1 in an exploded configuration.
Figure 5:
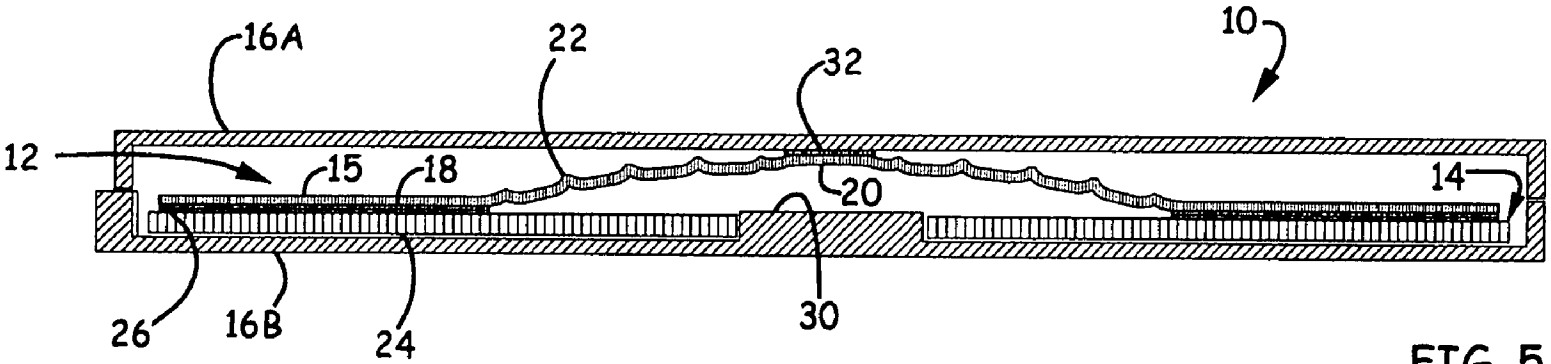
FIG. 5 is a cross sectional view of the manually operated rotatable animation device taken along the line 5-5 in FIG. 1.
Figure 6:
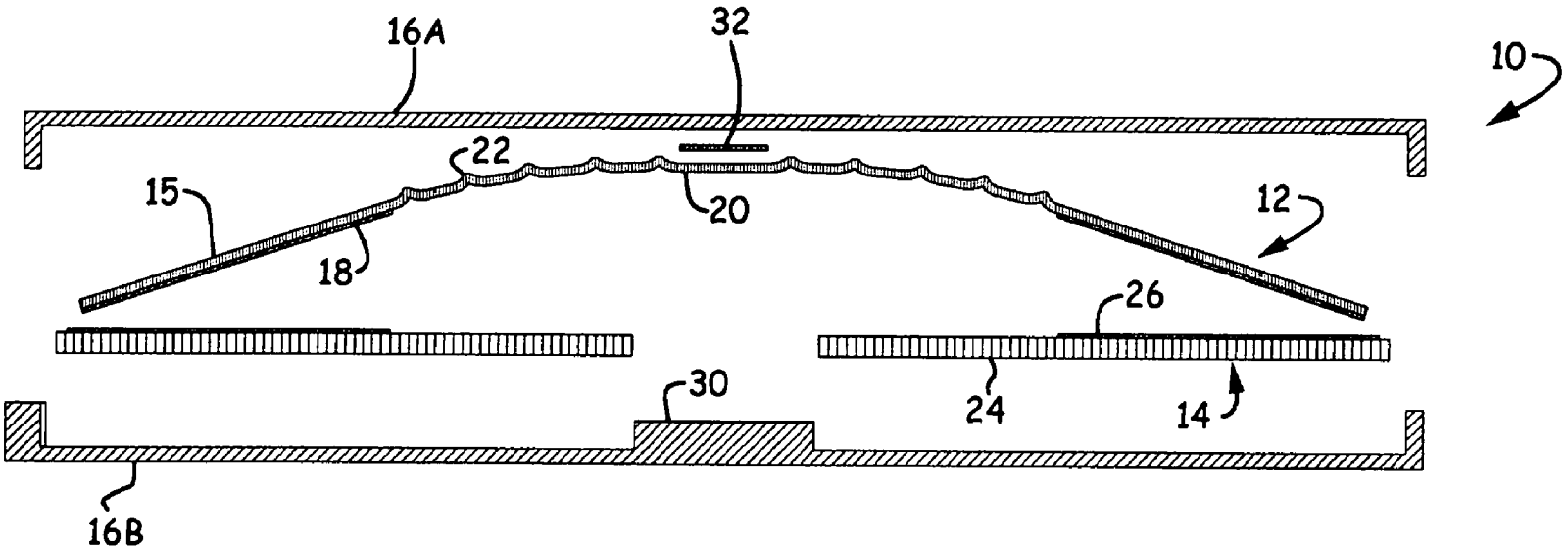
FIG. 6 is a cross sectional view of the manually operated rotatable animation device taken along the line 5-5 in FIG. 1 in an exploded configuration.
Figure 7:
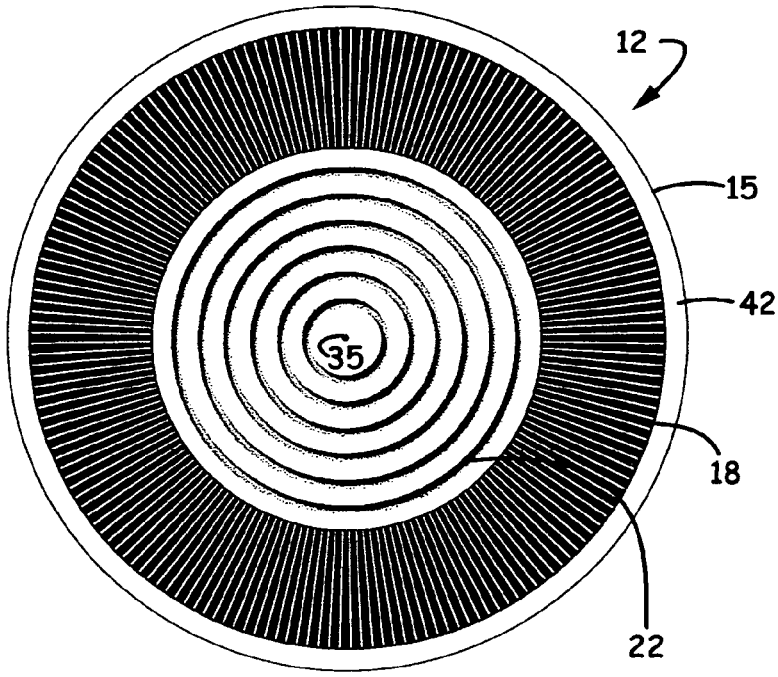
FIG. 7 is a top plan view of a shutter member of the manually operated rotatable animation device of FIG. 9.
Figure 8:
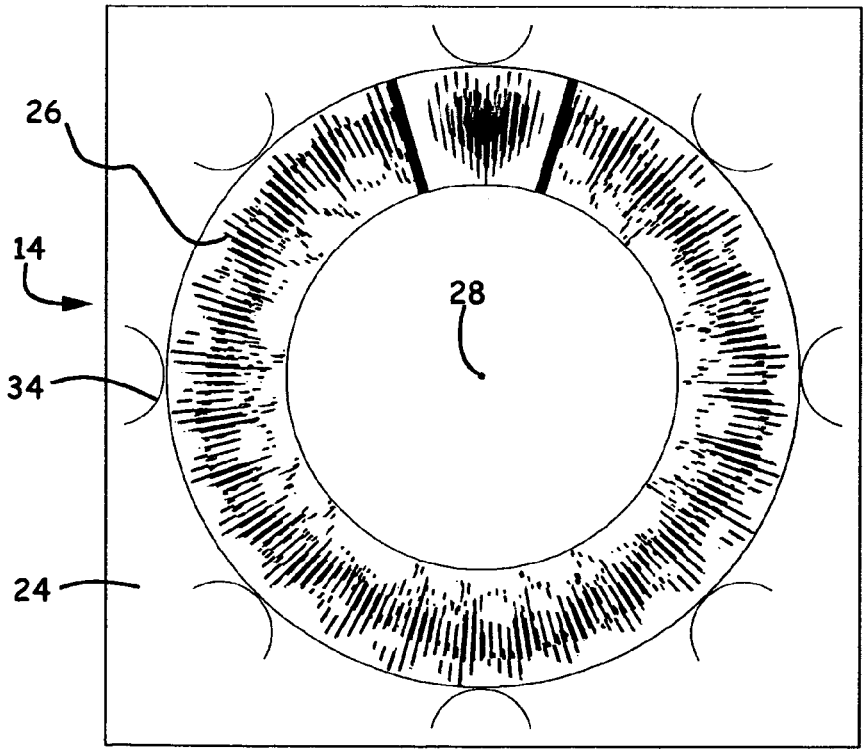
FIG. 8 is a top plan view of an image member of the manually operated rotatable animation device of FIG. 9.
Figure 9:
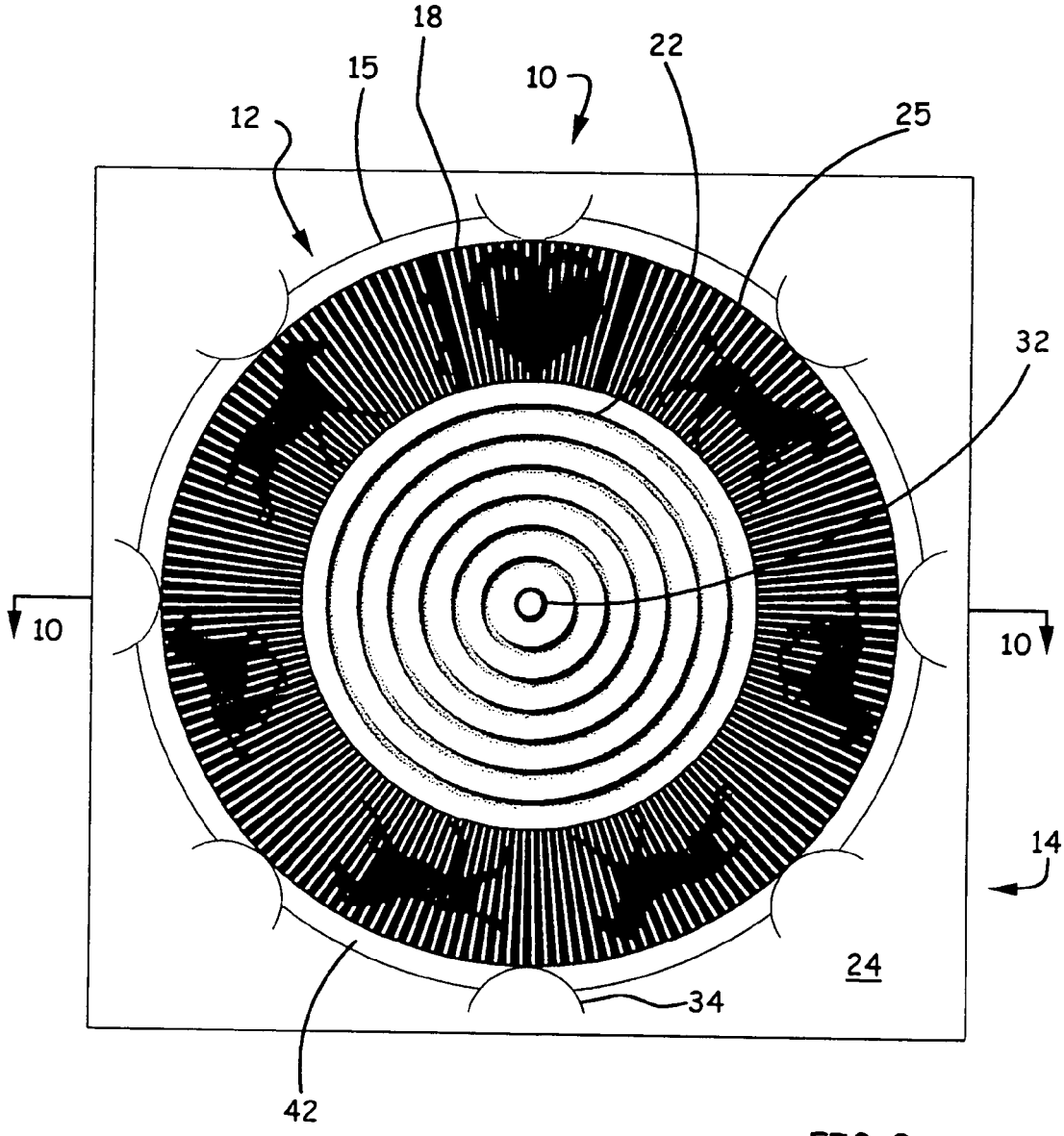
FIG. 9 is a top plan view of an alternative manually operated rotatable animation device pursuant to the present invention.

Looking more particularly to the drawings, a rotatable animation device according to the present invention is indicated generally at 10 in FIG. 1 where the rotatable animation device 10 is shown fully assembled and again in FIG. 4 where the rotatable animation device 10 is depicted in an exploded configuration. For additional clarity, FIG. 5 depicts the rotatable animation device 10 in cross section in a fully assembled configuration while FIG. 6 provides a cross-sectional view of the rotatable animation device 10 in an exploded arrangement.

By combined reference to FIG. 1 and FIGS. 4 through 6, one can perceive that the rotatable animation device 10 in this exemplary embodiment has a shutter member 12 and a coded image member 14 disposed within a case 16 that is formed by a first case half 16A and a second case half 16B. The first case half 16A and, possibly, the second case half 16B can be transparent to allow an observer to view the shutter member 12 and the coded image member 14.

The first and second case halves 16A and 16B can be coupled in any appropriate manner. For example, in the present embodiment, the first and second case halves 16A and 16B are hingedly connected by a mating engagement between a hinge pin 40 on the first case half 16A and a corresponding indentation or aperture 38 on the second case half 16B. The first and second case halves 16A and 16B could alternatively be coupled by one or more living hinges (not shown) or by any other effective mechanism. Still further, the first and second case halves 16A and 16B could be fixed to one another as by adhesive, fasteners, or by being integrally formed.

Figure 2:
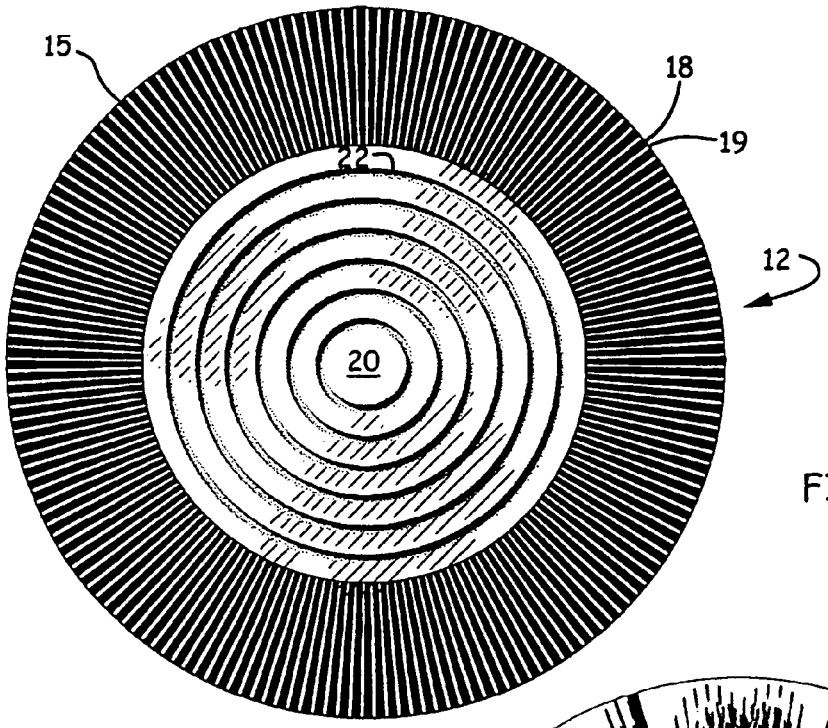
FIG. 2 is a top plan view of a shutter member of the manually operated rotatable animation device of FIG. 1.

The shutter member 12, which is shown alone in FIG. 2, in this example is disk shaped and is founded on a round substrate member 15, which is preferably transparent. Opaque shutter elements 18 are radially disposed in a ring shape adjacent to the peripheral edge of the substrate member 15. Radial transparent viewing sections 19 are disposed between the opaque shutter elements 18. The shutter elements 18 can be formed in any effective manner and from any suitable material. In one example, the shutter elements 18 could be formed of ink and could be printed onto the substrate member 15. Alternatively, the shutter elements 18 could be formed from paint, solid material, or any other effectively opaque arrangement. The viewing sections 19 could simply comprise portions of the substrate member 15 where no shutter element 18 is disposed. Alternatively, the viewing sections 19 could comprise apertures in the substrate member 15 or any other effectively transparent arrangement.

Figure 3:
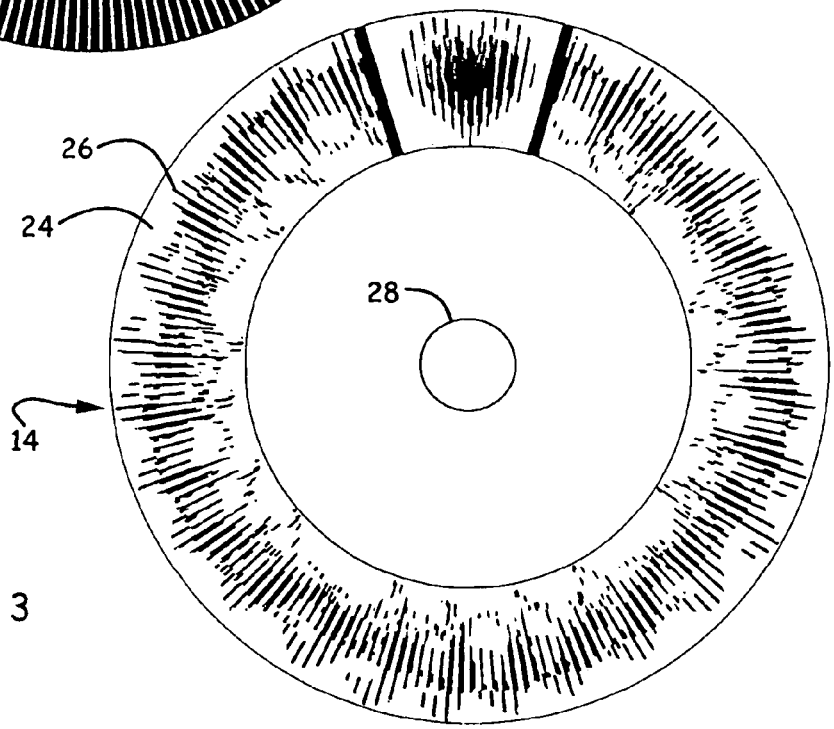
FIG. 3 is a top plan view of an image member of the manually operated rotatable animation device of FIG. 1.

The coded image member 14, which is shown alone in FIG. 3, is also disk shaped in the present embodiment. The coded image member 14 is based on a round substrate member 24. The substrate member 24 can be generally rigid and can have an opaque surface. The coded image member 14 can have a concentrically disposed central aperture 28. A plurality of coded images 26 can be radially disposed in a ring shape to correspond to the ring shape of the shutter elements 18 adjacent to the peripheral edge of the substrate member 24. The coded images 26 can be formed in any suitable manner on the substrate member 24 including by any type of printing process. The coded images 26 can depict substantially any type of image. In the example of FIG. 1, the coded images 26 provide a progressive depiction of a running horse.

In one manifestation of the invention, the case 16 could take the form of a compact disk case, and the coded image member 14 could comprise a compact disk. The coded images 26 could be printed directly onto the disk as the substrate member 24. Alternatively, the coded images 26 could be printed onto a label, which could be adhered to the substrate member 24.

The coded image member 14 can be rotatably retained relative to the case 16. The rotatable retention could be accomplished in any effective manner. In the present example, the coded image member 14 is rotatably retained about its central aperture 28 by an annular hub 30 that is fixed relative to the second case half 16B. Although not shown in the present embodiment, any other arrangement could be employed for rotatably retaining the coded image member 14 including, by way of an example, a peripheral ring or peripheral protuberances disposed on the case 16.

The shutter member 12 can be fixed against rotation relative to the case 16. For example, in the embodiment of FIGS. 1 and 4 through 6, the shutter member 12 is fixed against rotation by a volume of adhesive 32 disposed between a central portion 20 of the shutter member 12 and the first case half 16A. Of course, innumerable other means are possible for retaining the shutter member 12 against rotation including, for example, heat welding, mechanical fasteners, integral formation, and any other effective arrangement.

As in the present example, the coded image member 14 can have a diameter greater than the diameter of the shutter member 12. A portion of the peripheral edge of the coded image member 14 can be exposed relative to the case 16, such as by arcuate indentations 36 and 34 in the edges of the first and second case halves 16A and 16B. Of course, it would also be possible to form the coded image member 14 with a diameter larger than the width or depth of the case 16 such that a portion of the coded image member 14 would project therefrom.

Still further, the coded image member 14 could be disposed off center in relation to the case 16 thereby to cause a portion of the coded image member 14 to project from the case 16. Even further, the case 16 can have a concave opening in the side thereof for enabling access to an edge of the coded image member 14. In another alternative, an aperture, such as an arcuate cutout that could correspond to a portion of a viewing area where the shutter elements 18 complete the coded images 26, can be provided in either or both of the first and second case halves 16A and/or 16B for enabling access to a surface of either or both of the shutter member 12 and the coded image member 14. In still other alternatives, a drive mechanism, whether manual or automatic, can enable a rotatable driving of the coded image member 14.

In any case, some such means can be provided for enabling a user to induce a rotation of the coded image member 14 in relation to the case 16 and the shutter member 12. The rotation of the coded image member 14 will in turn yield an animation by the rotatable animation device 10 as the shutter elements 18 and viewing sections 19 cooperate to complete the coded images 26 in a sequential manner.

It should be noted, of course, that the depicted disposition of the shutter elements 18 and the coded images 26, while possibly preferred under certain arrangements, is merely exemplary. The relative disposition of the shutter elements 18 and the coded images 26 could readily be reversed. The shutter elements 18 and the coded images 26 could be readily interchanged such that the coded images 26 could be disposed on the substrate member 15 and the shutter elements 18 could be disposed on the substrate member 24. Particularly where the coded images 26 and the shutter elements 18 have been printed with the same color ink, the animated effect will be similar regardless of which is imprinted on or otherwise applied or coupled to the substrate 15 and which is imprinted on or otherwise applied or coupled to the substrate member 24. Also, while it may be preferred to have the coded images 26 and the shutter elements 18 printed on facing surfaces as is shown in the present embodiment, such a disposition is not necessarily required.

It will also be noted that the plurality of shutter elements 18 may assume a wide variety of shapes including straight bars, curving bars, apertured opaque portions, and any other functioning configuration. Naturally, the shapes of the coded images 26 would normally correspond to the shapes of the shutter elements 18. The plurality of viewing elements 19 interposed between the shutter elements 18 could comprise open slots, transparent bars, or any other means that would allow a selective viewing of the coded images 26.

As noted previously, a basic goal of the present invention is to induce complete, substantially complete, or at least visually effective contact between the image display portions of the rotatable animation device 10, which in this case are the rings formed by the coded images 26 and the shutter elements 18. To accomplish that, one or both of the substrate members 15 and, additionally or alternatively, 24 can be formed from a flexible material and can be formed with or induced to have a concave portion. In this embodiment, only the substrate member 15 has a concave cross section and is formed from a flexible material. The substrate member 15 can be formed from plastic, rubber, or any other effectively pliable or flexible material or arrangement. In one presently contemplated embodiment, the substrate member 15 comprises a flexible disk of cellulose acetate. The substrate member 24 can be substantially rigid.

As can be perceived most clearly by reference to FIGS. 5 and 6, the substrate member 15 has a generally symmetrical, arcuate cross section. The substrate member 15 has a non-compressed height that is greater than the distance of separation between the substrate member 24 and the inner surface of the first case half 16A. With this, the inner surface of the first case half 16A will tend to press upon and, to a given degree, compress and flatten the concave substrate member 15. With this, the ring of shutter elements 18 on the substrate member 15 will be biased toward the ring of coded images 26 on the substrate member 24.

Due to the flexibility of the substrate member 15, at least a peripheral ring portion thereof will conform to and make full contact with a corresponding ring portion of the substrate member 24. As a result, areas of non-contact between the shutter elements 18 and the coded images 26 will tend to be minimized or, ideally, eliminated. With this, smooth, bright, and clear animation will be obtained when the coded image member 14 is rotated in relation to the shutter member 12, and, if desired, additional phases of animation can be realized. The improved contact between the coded images 26 and the shutter elements 18 can be achieved without a need for imparting excessive compressive force on the shutter member 12 or the coded image member 14, which otherwise might impede rotation of the coded image member 14 relative to the shutter member 12.

The concave configuration of the substrate member 15 could be formed or induced by a wide variety of methods. In the embodiment of FIGS. 1, 2, and 4 through 6, by way of example, the substrate member 15 is induced into a concave bowl shape with the shutter elements 18 disposed to the concave side of the substrate member 15 by the formation of one or more indentations, such as creases 22, therein. In this case, the creases 22 are formed in concentric rings and are disposed radially inward of the ring of shutter elements 18. As FIGS. 5 and 6 show, the creases 22 can have their peaks to what becomes the convex side of the substrate member 15 whereby the substrate member 15 will be pinched and biased into the desired concave configuration.

Of course, creases 22 could be formed in other configurations including in a spiral format, in plural arcuate sections, or in any other effective arrangement. Similarly, other surface indentations or formations, including point indentations, may alternatively or additionally be employed to induce the substrate member 15 into a concave configuration. The surface indentations can be formed in any manner including during a die cutting procedure where a die is employed to cut or otherwise form the substrate member 15. The surface indentations in the present embodiment start immediately adjacent to the central portion 20 of the substrate member 15 and terminate a sufficient distance away from the ring of shutter elements 18 to avoid interfering with their full contact with the coded images 26.

Of course, the substrate member 15 could be formed originally or rendered concave by other methods including vacuum forming, molding, and any other effective method. For example, the substrate member 15 could simply be molded or otherwise formed into a bowl configuration with no need for individual formations or indentations.

An alternative embodiment of the rotatable animation device 10 is depicted in FIGS. 7 through 11. The rotatable animation device 10, shown assembled in FIG. 9, again provides animation based on a rotation of a shutter member 12 in relation to a coded image member 14. The shutter member 12, shown alone in FIG. 7, again has a plurality of radially oriented, alternating shutter elements 18 and viewing elements 19, and the coded image member 14, shown alone in FIG. 8, again has coded images 26 radially disposed thereon. Also, the shutter member 12 can again have a concave configuration to provide complete contact between the shutter elements 18 and coded images 26 as described previously.

The shutter member 12 will again preferably be formed from a flexible material, and the coded image member 14 will again preferably be generally rigid. For example, the substrate member 15 can be formed from a clear polymeric material, such as cellulose acetate, while the substrate member 24 can be formed from an opaque material, such as paper, card stock, cardboard, plastic, wood, metal, or any other suitable material.

Figure 10:
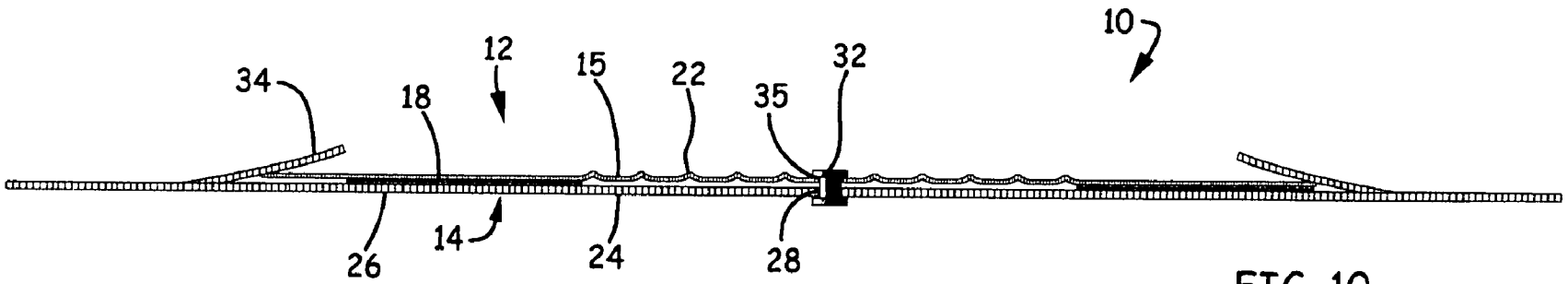
FIG. 10 is a cross sectional view of the manually operated rotatable animation device of FIG. 9 taken along the line 10-10.
Figure 11:
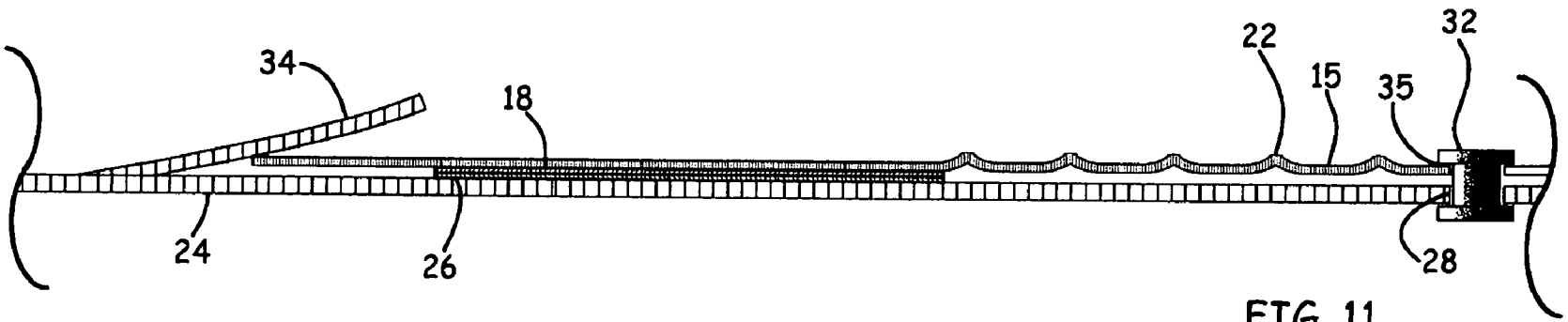
FIG. 11 is a magnified view of a portion of the cross-sectioned manually operated rotatable animation device of FIG. 10.
Figure 12:
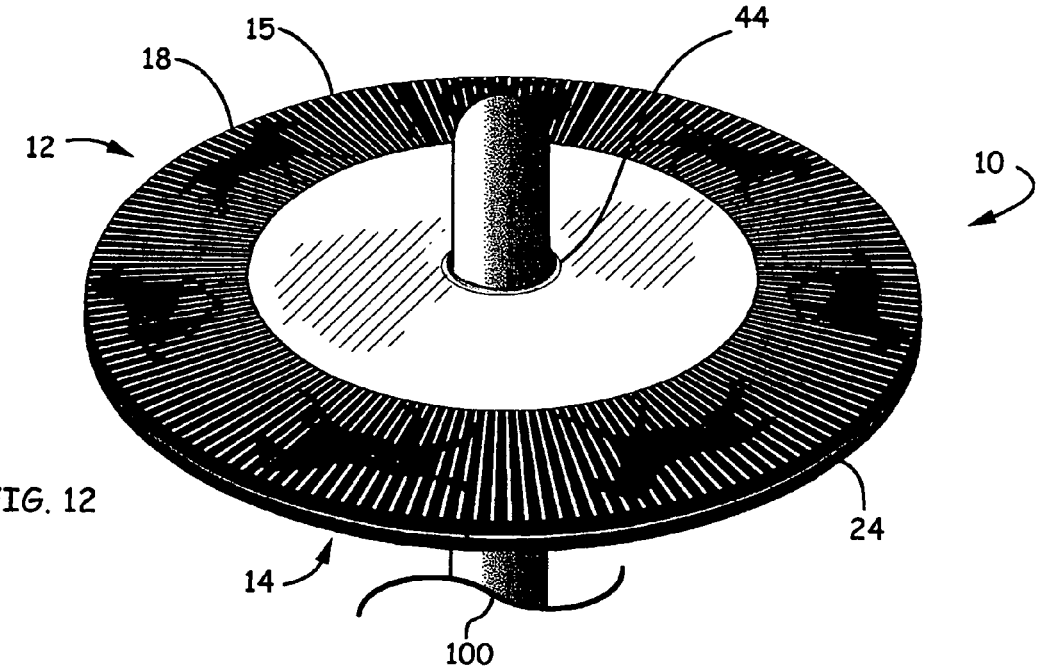
FIG. 12 is a perspective view of yet another embodiment of a manually operated rotatable animation device pursuant to the instant invention.
Figure 13:
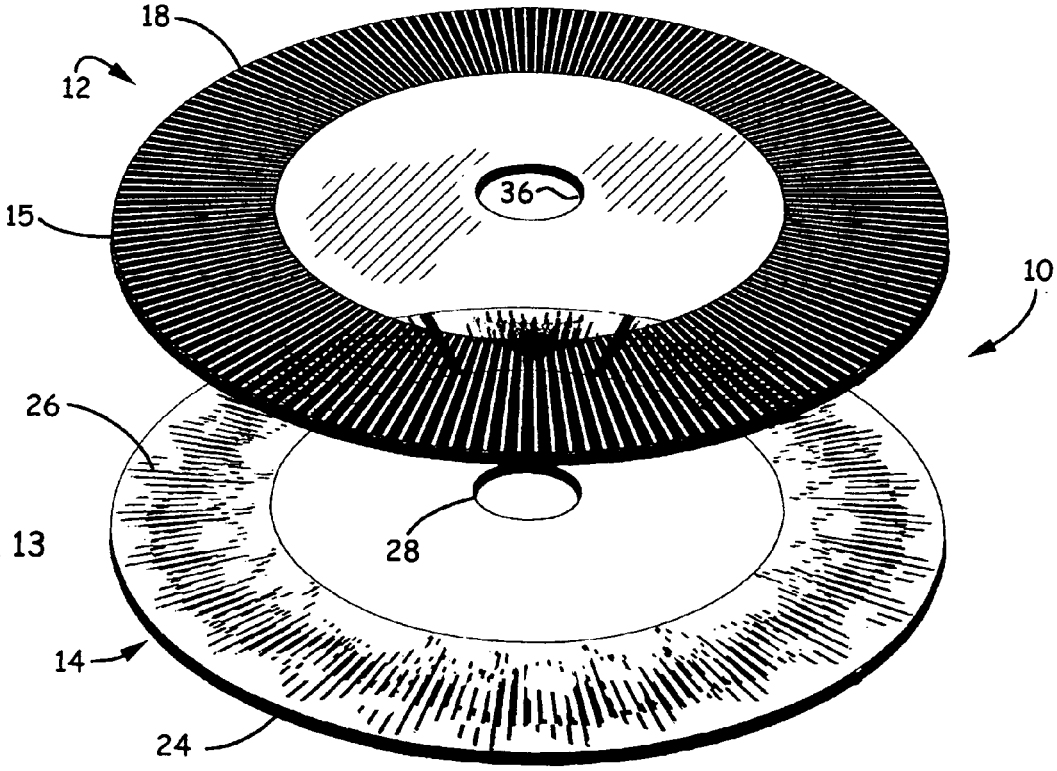
FIG. 13 is a perspective view of the shutter member and image member of a manually operated rotatable animation device in an exploded configuration.

In this case, however, the shutter member 12 is biased into contact with the coded image member 14 by a concentrically disposed fastener 32 that passes through a centered aperture 35 in the shutter member 12 and through a centered aperture 28 in the coded image member 14. With this, the shutter member 12 and the coded image member 14 are secured together while permitting a concentric rotation of the shutter member 12 in relation to the coded image member 14.

Where necessary or desirable, the peripheral edge 42 of the shutter member 12 can be retained relative to the coded image member 14 by a plurality of angularly spaced tabs 34 formed in or fixed to the substrate member 24 of the coded image member 14. As FIGS. 10 and 11 show, tabs 34 can overlie the peripheral edge 42 of the shutter member 12. To prevent any obscuring of the images 25 depicted by the rotatable animation device 10, the peripheral edge 42 of the shutter member 12 can be clear of shutter elements 18, and the tabs 34 can be located to remain clear of the shutter elements 18 and coded images 26. Yet another embodiment of the rotatable animation device 10 is depicted in FIGS. 12 and 13. There, the substrate member 15 of the shutter member 12 and the substrate member 24 of the coded image member 14 are each formed from a rigid, flat disk. The substrate member 15 of the shutter member 12 can be clear and can be formed from any rigid material including plastic or glass. The substrate member 24 of the coded image member 14 can be opaque and can also be of plastic or glass. In certain embodiments, the shutter member 12 and the coded image member 14 can comprise compact disks.

As FIG. 12 shows, the shutter member 12 and the coded image member 14 can be retained in a relatively rotatable manner by a hub arrangement 44 to ensure close contact therebetween. The hub arrangement 44 can, for example, comprise a snap hub 44 with an axial portion for passing through the apertures 28 and 36 and radial portions for retaining the shutter and image members 12 and 14 in close contact. An axle 100 can retain the rotatable animation device 10 by passing through the snap hub 44 and through the apertures 28 and 36.

It is also possible within the scope of the invention to dispense with the hub arrangement 44 and to allow the shutter member 12 and the coded image member 14 to achieve close contact merely by operation of gravity and, additionally or alternatively, pressure induced by the user. The apertures 28 and 36 can be sized to receive a finger of a user or an axle 100 that allows relative rotation of the shutter member 12 and the coded image member 14. To ensure that full contact will be achieved, the shutter member 12 and the coded image member 14 can be induced to rotate about a generally vertical axis.

With certain embodiments of the present invention for a rotatable animation device disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft animation devices that incorporate certain inventive aspects of the disclosed rotatable animation devices while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof whether now known or hereafter developed or discovered.

I claim as deserving the protection of Letters Patent:

1. A rotatable animation device for displaying a plurality of images, the animation device comprising:

a first substrate member with an inner surface and an outer surface;

a second substrate member with an inner surface facing the inner surface of the first substrate member and an outer surface wherein the first substrate member is rotatable in relation to the second substrate member;

a plurality of coded images disposed on one of the first substrate member and the second substrate member;

a plurality of shutter elements disposed on the other of the first substrate member and the second substrate member;

a plurality of viewing sections interposed between the plurality of shutter elements;

wherein the plurality of shutter elements and the plurality of viewing sections are disposed to align with the plurality of coded images to establish a viewing area wherein the plurality of shutter elements sequentially complete the plurality of coded images in response to a relative rotation between the first substrate member and the second substrate member;

wherein at least a portion of the first substrate member is flexible over a flexible portion whereby the flexible portion of the first substrate member can deflect to make contact with the second substrate member;

wherein at least a portion of the first substrate member is compressible wherein a pressing on the first substrate member will induce a deflection of the first substrate member from a non-compressed configuration to a compressed configuration; and wherein the inner surface of the first substrate member has a resilient concave portion whereby a pressing on the first substrate member will induce a deflection of the resilient concave portion of the first substrate member to a compressed configuration.

2. The animation device of claim 1 wherein the resilient concave portion of the first substrate member includes at least a ring portion of the first substrate member and wherein the plurality of coded images, the plurality of shutter elements, and the plurality of viewing sections are radially disposed on the first and second substrate members to define a generally annular viewing area.

3. The animation device of claim 1 wherein at least a portion of the first substrate member has a bowl shape.

4. The animation device of claim 1 wherein the resilient concave portion of the first substrate member is biased to a concave configuration at least partially by at least one biasing surface deformation disposed in the first substrate member.

5. The animation device of claim 4 wherein the at least one surface deformation is generally annular.

6. The animation device of claim 4 wherein the at least one surface deformation comprises a crease with a peak disposed along the outer surface of the first substrate member.

7. The animation device of claim 1 further comprising a means for rotatably retaining the first substrate member in relation to the second substrate member and a means for inducing a compression of the first substrate member to induce contact of the inner surfaces of the first and second substrate members.

8. The animation device of claim 7 wherein the means for inducing a compression of the first substrate member to induce contact of the inner surfaces of the first and second substrate members comprises a case with a first case half disposed outboard of the outer surface of the first substrate member and a second case half disposed outboard of the outer surface of the second substrate member.

9. The animation device of claim 8 wherein the first and second case halves are hingedly coupled, wherein the second substrate member comprises a disk, and wherein at least a portion of an edge of the second substrate member is exposed in relation to the case.

10. The animation device of claim 7 wherein at least the first substrate member has a centrally disposed aperture and wherein the means for inducing a compression of the first substrate member to induce contact of the inner surfaces of the first and second substrate members comprises a concentrically disposed fastening arrangement.

11. The animation device of claim 7 wherein the first substrate member is annular and wherein the means for inducing a compression of the first substrate member to induce contact of the inner surfaces of the first and second substrate members further comprises a plurality of tabs disposed about a periphery of the first substrate member.

12. A rotatable animation device for displaying a plurality of images, the animation device comprising:

a first substrate member with an inner surface and an outer surface;

a second substrate member with an inner surface facing the inner surface of the first substrate member and an outer surface wherein the first substrate member is rotatable in relation to the second substrate member;

a plurality of coded images disposed on one of the first substrate member and the second substrate member;

a plurality of shutter elements disposed on the other of the first substrate member and the second substrate member;

a plurality of viewing sections interposed between the plurality of shutter elements;

wherein the plurality of shutter elements and the plurality of viewing sections are disposed to align with the plurality of coded images to establish a viewing area wherein the plurality of shutter elements sequentially complete the plurality of coded images in response to a relative rotation between the first substrate member and the second substrate member and wherein the plurality of coded images, the plurality of shutter elements, and the plurality of viewing sections are radially disposed on the first and second substrate members thereby to define a generally annular viewing area; and wherein the inner surface of the first substrate member has a resilient concave portion whereby a pressing on the first substrate member will induce a deflection of the resilient concave portion of the first substrate member from a non-compressed configuration to a compressed configuration to induce contact between the inner surfaces of the first and second substrate members.

13. The animation device of claim 12 wherein the resilient concave portion of the first substrate member includes at least a ring portion of the first substrate member whereby at least the ring portion of the first substrate member can deflect into contact with the inner surface of the second substrate member.

14. The animation device of claim 13 wherein at least a portion of the first substrate member has a bowl shape.

15. The animation device of claim 12 wherein the resilient concave portion of the first substrate member is biased to a concave configuration at least partially by at least one biasing surface deformation disposed in the first substrate member.

16. The animation device of claim 15 wherein the at least one surface deformation comprises a crease with a peak disposed along the outer surface of the first substrate member.

17. The animation device of claim 12 further comprising a means for rotatably retaining the first substrate member in relation to the second substrate member and a means for inducing a compression of the first substrate member to induce contact of the inner surfaces of the first and second substrate members.

18. The animation device of claim 17 wherein the means for inducing a compression of the first substrate member to induce contact of the inner surfaces of the first and second substrate members comprises a case with a first case half disposed outboard of the outer surface of the first substrate member and a second case half disposed outboard of the outer surface of the second substrate member.

* * * * *